US010672544B2

(12) United States Patent
Masusawa et al.

(10) Patent No.: US 10,672,544 B2
(45) **Date of Patent: *Jun. 2, 2020**

(54) R-T-B BASED PERMANENT MAGNET

(71) Applicant: TDK CORPORATION, Tokyo (JP)

(72) Inventors: Kiyoyuki Masusawa, Tokyo (JP); Makoto Nakane, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/833,212

(22) Filed: Dec. 6, 2017

(65) Prior Publication Data

US 2018/0158582 A1 Jun. 7, 2018

(30) Foreign Application Priority Data

Dec. 6, 2016 (JP) ..... 2016-237149
Dec. 5, 2017 (JP) ..... 2017-233839

(51) Int. Cl.

| | |
|---|---|
| ***H01F 1/057*** | (2006.01) |
| ***C22C 38/16*** | (2006.01) |
| ***C22C 38/14*** | (2006.01) |
| ***C22C 38/10*** | (2006.01) |
| ***C22C 38/00*** | (2006.01) |
| ***C22C 38/06*** | (2006.01) |

(Continued)

(52) U.S. Cl.

CPC ..... *H01F 1/057* (2013.01); *C22C 38/001* (2013.01); *C22C 38/002* (2013.01); *C22C 38/005* (2013.01); *C22C 38/04* (2013.01); *C22C 38/06* (2013.01); *C22C 38/10* (2013.01); *C22C 38/14* (2013.01); *C22C 38/16* (2013.01); *H01F 1/0577* (2013.01); *B22F 1/0007* (2013.01); *B22F 2998/10* (2013.01); *B22F 2999/00* (2013.01); *C22C 2202/02* (2013.01)

(58) Field of Classification Search

None

See application file for complete search history.

(56) References Cited

U.S. PATENT DOCUMENTS

2008/0245442 A1 10/2008 Nakamura et al.
2009/0297699 A1* 12/2009 Baba ..... H01F 41/026 427/127

(Continued)

FOREIGN PATENT DOCUMENTS

EP 0345092 A1 12/1989
EP 1467385 A1 10/2004

(Continued)

*Primary Examiner* — Xiaowei Su
(74) *Attorney, Agent, or Firm* — Oliff PLC

(57) ABSTRACT

An object of the present invention is to provide an R-T-B based permanent magnet showing high residual magnetic flux density Br and coercive force HcJ. Provided is an R-T-B based permanent magnet in which, R is a rare earth element, T is an element other than the rare earth element, B, C, O or N, and B is boron. R at least includes Tb and T at least includes Fe, Cu, Co and Ga, and a total of R content is 28.05 to 30.60 mass %, Cu content is 0.04 to 0.50 mass %, Co content is 0.5 to 3.0 mass %, Ga content is 0.08 to 0.30 mass %, and B content is 0.85 to 0.95 mass %, relative to 100 mass % of a total mass of R, T and B, and Tb concentration reduces from outside to inside of the R-T-B based permanent magnet.

11 Claims, 1 Drawing Sheet

(51) Int. Cl.
*C22C 38/04* (2006.01)
*B22F 1/00* (2006.01)

(56) References Cited

U.S. PATENT DOCUMENTS

| | | | | |
|---|---|---|---|---|
| 2010/0233016 | A1* | 9/2010 | Tsubokura | C22C 33/0278 420/83 |
| 2011/0025440 | A1* | 2/2011 | Kuniyoshi | C22C 33/0278 335/302 |
| 2011/0150691 | A1 | 6/2011 | Nakamura et al. | |
| 2013/0026870 | A1* | 1/2013 | Baba | C22C 38/005 310/152 |
| 2013/0293328 | A1* | 11/2013 | Kuniyoshi | B22F 3/24 335/302 |
| 2015/0170810 | A1* | 6/2015 | Miwa | C22C 38/001 75/246 |
| 2016/0012946 | A1* | 1/2016 | Horikita | C22C 33/0278 419/31 |

FOREIGN PATENT DOCUMENTS

| | | | | |
|---|---|---|---|---|
| EP | 1562203 | A1 | 8/2005 | |
| EP | 2226137 | A1 | 9/2010 | |
| JP | H04-006806 | A | 1/1992 | |
| JP | 2003-257721 | A | 9/2003 | |
| JP | 2003-257768 | A | 9/2003 | |
| WO | 2006/043348 | A1 | 4/2006 | |
| WO | WO-2013191276 | A1 * | 12/2013 | C22C 38/001 |

* cited by examiner

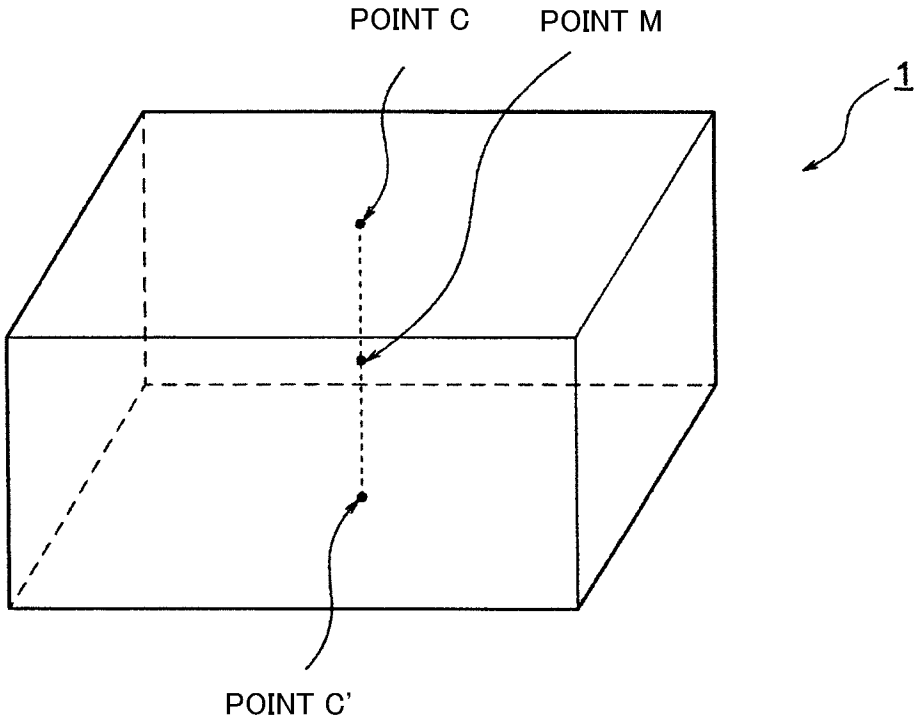
1
POINT C
POINT M
POINT C'

R-T-B BASED PERMANENT MAGNET

BACKGROUND OF THE INVENTION

1. Field of the Invention

The present invention relates to an R-T-B based permanent magnet.

2. Description of the Related Art

Rare earth permanent magnet having an R-T-B based composition is a magnet showing superior magnetic properties, and many investigations aiming for further improvement of the magnetic properties are being performed. Indexes for expressing the magnetic properties are generally residual magnetic flux density (residual magnetization) Br and coercive force HcJ. Magnet having high values thereof is determined to have superior magnetic properties.

Patent Document 1 mentions a rare earth permanent magnet, in which a magnet body is immersed in slurry in which fine powder including rare earth element is dispersed in water or organic solvent, heated thereof, and the rare earth element is diffused into the magnet body along the grain boundaries.

Patent Document 1: A brochure of WO 2006/43348

DISCLOSURE OF THE INVENTION

Means for Solving the Problems

An object of the present invention is to provide an R-T-B based permanent magnet showing high residual magnetic flux density Br and coercive force HcJ.

In order to achieve the above object, the R-T-B based permanent magnet of the invention provides, an R-T-B based permanent magnet in which, "R" is a rare earth element, "T" is an element other than the rare earth element, "B", "C", "O" or "N", and "B" is boron, "R" at least includes Tb, "T" at least includes Fe, Cu, Co and Ga, a total of "R" content is 28.05 to 30.60 mass %, Cu content is 0.04 to 0.50 mass %, Co content is 0.5 to 3.0 mass %, Ga content is 0.08 to 0.30 mass %, and "B" content is 0.85 to 0.95 mass %, relative to 100 mass % of a total mass of "R", "T" and "B", and Tb concentration reduces from outside to inside of the R-T-B based permanent magnets.

The R-T-B based permanent magnet of the invention can improve residual magnetic flux density Br and coercive force HcJ by having the characteristics above.

"R" may include at least a light rare earth element, "R" content may be 29.25 to 30.60 mass %, and a total of the light rare earth element content may be 29.1 to 30.1 mass %.

"R" may include at least Nd.

"R" may include at least Pr. Pr content may be more than zero to 10.0 mass % or less.

"R" may include at least Nd and Pr.

"T" may further include Al. Al content may be 0.15 to 0.30 mass %.

"T" may further include Zr. Zr content may be 0.10 to 0.30 mass %.

The R-T-B based permanent magnet may further include "C". "C" content may be 1100 ppm or less relative to a total mass of the R-T-B based permanent magnet.

The R-T-B based permanent magnet may further include "N". "N" content may be 1000 ppm or less relative to the total mass of the R-T-B based permanent magnet.

The R-T-B based permanent magnet may further include "O". "O" content may be 1000 ppm or less relative to the total mass of the R-T-B based permanent magnet.

An atomic ratio of Tb/C may be 0.10 to 0.95.

An atomic ratio of TRE/B may be 2.2 to 2.7, where TRE is a total of R content.

An atomic ratio of 14B/(Fe+Co) may be more than zero and 1.01 or less.

BRIEF DESCRIPTION OF THE DRAWINGS

FIG. 1 is a schematic view of the R-T-B based permanent magnet according to the present embodiment.

DESCRIPTION OF THE PREFERRED EMBODIMENTS

Hereinafter, the invention will be described based on the embodiment shown by the FIGURE.

<R-T-B Based Permanent Magnet>

R-T-B based permanent magnet 1 according to the embodiment includes grains made of $R_2T_{14}B$ crystals and grain boundaries thereof.

R-T-B based permanent magnet 1 according to the embodiment can be an optional shape.

R-T-B based permanent magnet 1 according to the embodiment can enhance residual magnetic flux density Br, coercive force HcJ, corrosion resistance and production stability by including a plural number of specific elements, including Tb, within a specified range of their content.

R-T-B based permanent magnet 1 according to the embodiment shows a concentration distribution in which Tb concentration reduces from outside to inside of the R-T-B based permanent magnet 1.

In concrete, as shown in FIG. 1, in case when a rectangular parallelepiped shaped R-T-B based permanent magnet 1 of the present embodiment includes a surface part and a central part, Tb content in the surface part may be higher than the same in the central part by 2% or more, 5% or more or 10% or more. Note, the surface part is the surface of R-T-B based permanent magnet 1. For instance, points C and C' in FIG. 1 are the surface part. Points C and C' are the centers of gravity of the surfaces facing each other in FIG. 1. The central part is a center part of R-T-B based permanent magnet 1. For instance, the central part is a half thickness part of R-T-B based permanent magnet 1. For instance, point M (a middle point between the points C and C') in FIG. 1 is the central part.

Any method for generating the aforementioned concentration distribution in the Tb content can be used, however, said Tb concentration distribution can be generated in the magnet by the grain boundary diffusion of Tb, described later "R" is the rare earth element. The rare earth element includes Sc, Y and lanthanoids, which belongs to the group III in the long-periodic table. Lanthanoids includes such as La, Ce, Pr, Nd, Sm, Eu, Gd, Tb, Dy, Ho, Er, Tm, Yb and Lu. In addition, R-T-B based permanent magnet according to the present embodiment always includes Tb as "R". Further, Nd is preferably included as "R".

The rare earth elements are generally classified as light rare earth elements and heavy rare earth elements. The light rare earth elements of R-T-B based permanent magnet according to the present embodiment are Sc, Y, La, Ce, Pr, Nd, Sm, Eu and the heavy rare earth elements of the same are Gd, Tb, Dy, Ho, Er, Tm, Yb and Lu.

"T" is an element other than the rare earth element, B, C, O or N. The R-T-B based permanent magnet according to the present embodiment at least includes Fe, Co, Cu and Ga as "T". One or more kinds of elements among the elements such as Al, Mn, Zr, Ti, V, Cr, Ni, Nb, Mo, Ag, Hf, Ta, W, Si, P, Bi, Sn can be further included as "T".

"B" is boron.

A total of "R" content in the R-T-B based permanent magnet of the present embodiment is 28.05 mass % or more to 30.60 mass % or less, relative to 100 mass % of a total mass of R, T and B. In case when the total of "R" content is less than 28.05 mass %, the coercive force HcJ decreases. In case when the total of "R" content exceeds 30.60 mass %, the residual magnetic flux density Br decreases. The total of "R" content may be 28.25 mass % or more to 30.60 mass % or less, 29.25 mass % or more to 30.60 mass % or less, 29.45 mass % or more to 30.60 mass % or less, or 29.45 mass % or more to 30.45 mass % or less.

In case when a total of the light rare earth element content in the R-T-B based permanent magnet of the present embodiment is defined as TRL and a total mass amount of "R", "T" and "B" is 100 mass %, TRL may be 27.9 mass % or more and 30.1 mass % or less or 29.1 mass % or more and 30.1 mass % or less. In case when TRL is within the above range, the residual magnetic flux density and coercive force HcJ can be further enhanced.

The R-T-B based permanent magnet according to the present embodiment includes Nd in an optional content. Nd content may be zero to 30.1 mass %, zero to 29.6 mass %, 19.6 to 29.6 mass %, 19.6 to 24.6 mass % or 19.6 to 22.6 mass %, relative to 100 mass % of a total mass of R, T and B. Pr content may be zero to 10.0 mass %. Namely, Pr may not be included. The R-T-B based permanent magnet according to the present embodiment may at least include Nd and Pr as "R". Pr content may be 5.0 mass % or more and 10.0 mass % or less, and further, it may be 5.0 mass % or more and 7.5 mass % or less. In case when Pr content is 10.0 mass % or less, temperature coefficient of the coercive force HcJ is superior. In particular, to improve the coercive force HcJ at high temperature, Pr content is preferably zero to 7.5 mass %.

In addition, R-T-B based permanent magnet according to the present embodiment may include 1.0 mass % or less in total of the heavy rare earth element with respect to 100 mass % of a total mass of "R", "T" and "B". The heavy rare earth element always includes Tb, and may further include Dy. It becomes easy to keep good residual magnetic flux density when a total of the heavy rare earth element content is 1.0 mass % or less. As the heavy rare earth element, substantially, it may only be Tb. Tb content in this case is 0.15 mass % or more and 1.0 mass % or less, 0.15 mass % or more and 0.75 mass % or less, and 0.15 mass % or more and 0.5 mass % or less. Coercive force HcJ tends to decrease when Tb content is less than 0.15 mass %. Residual magnetic flux density Br tends to decrease when Tb content exceeds 1.0 mass %.

Cu content is 0.04 mass % or more and 0.50 mass % or less relative to 100 mass % of the total mass of "R", "T" and "B". Coercive force HcJ tends to decrease when Cu content is less than 0.04 mass %. In case when Cu content exceeds 0.50 mass %, coercive force HcJ tends to decrease and residual magnetic flux density Br also tends to decrease. In addition, Cu content may be 0.10 mass % or more and 0.50 mass % or less, and may be 0.10 mass % or more and 0.30 mass % or less. The corrosion resistance tends to improve by making Cu content 0.10 mass % or more.

Ga content is 0.08 mass % or more and 0.30 mass % or less relative to 100 mass % of the total mass of "R", "T" and "B". Coercive force HcJ sufficiently increases when Ga content is 0.08 mass % or more. A sub-phase, such as an R-T-Ga phase, tends to form and residual magnetic flux density Br tends to decrease when Ga content exceeds 0.30 mass %. In addition, Ga content may be 0.10 mass % or more and 0.25 mass % or less.

Co content is 0.5 mass % or more and 3.0 mass % or less relative to 100 mass % of the total mass of R, T and B. The corrosion resistance improves by including Co. The corrosion resistance of the finally obtained R-T-B based permanent magnet deteriorates when Co content is less than 0.5 mass %. Improvement effects of the corrosion resistance saturate and incur a high cost when Co content exceeds 3.0 mass %. Co content may be 1.0 mass % or more and 3.0 mass % or less.

Al content is 0.15 mass % or more and 0.30 mass % or less relative to 100 mass % of the total mass of "R", "T" and "B". In case when Al content is 0.15 mass % or more, coercive force HcJ can be increased. In addition, difference of the magnetic properties, especially coercive force HcJ, due to the changes of aging temperature or heat treatment temperature after the grain boundary diffusion becomes small, and the properties variance during mass production becomes small. Namely, the production stability improves. Residual magnetic flux density Br can be improved when Al content is 0.30 mass % or less. The temperature coefficient of coercive force HcJ can also be improved. Al content may be 0.15 mass % or more and 0.25 mass % or less. Difference of the magnetic properties, especially coercive force HcJ, due to the changes of the aging temperature or the heat treatment temperature after the grain boundary diffusion, become further small when Al content is 0.15 mass % or more and 0.25 mass % or less.

Zr content is 0.10 mass % or more and 0.30 mass % or less relative to 100 mass % of the total mass of "R", "T" and "B". Abnormal grain growth during sintering can be prevented and squareness ratio Hk/HcJ and magnetization ratio under a low magnetic field can be improved by including Zr. By making Zr content 0.10 mass % or more, the abnormal grain growth preventing effect during sintering by including Zr is enhanced, and the squareness ratio Hk/HcJ and the magnetization ratio under a low magnetic field can be improved. By making Zr content 0.30 mass % or less, the residual magnetic flux density Br can be improved. Zr content may be 0.15 mass % or more and 0.30 mass % or less, and may be 0.15 mass % or more and 0.25 mass % or less. By making Zr content 0.15 mass % or more, an optimal temperature range for the sintering becomes wide. Namely, the abnormal grain growth preventing effect during sintering is further enhanced. The properties variations become small and production stability improves.

In addition, R-T-B based permanent magnet according to the present embodiment may include Mn. In case of including Mn, Mn content may be 0.02 mass % to 0.10 mass % relative to 100 mass % of the total mass of "R", "T" and "B". By making Mn content 0.02 mass % or more, the residual magnetic flux density Br tends to increase and coercive force HcJ tends to increase. By making Mn content 0.10 mass % or less, the coercive force HcJ tends to increase. Mn content may be 0.02 mass % or more and 0.06 mass % or less.

"B" content in R-T-B based permanent magnet according to the present embodiment is 0.85 mass % or more to 0.95 mass % or less, relative to 100 mass % of the total mass of "R", "T" and "B". It becomes difficult to realize high squareness when "B" content is less than 0.85 mass %. Namely, it becomes difficult to enhance squareness ratio Hk/HcJ. The squareness ratio Hk/HcJ decreases when "B" content exceeds 0.95 mass %. "B" content may be 0.88 mass % or more and 0.94 mass % or less. Residual magnetic flux density Br tends to increase further more when "B" content is 0.88 mass % or more. Coercive force HcJ tends to increase further more when "B" content is 0.94 mass % or less.

An atomic ratio of TRE/B may be 2.2 or more and 2.7 or less, where TRE is a total of "R" element content. The atomic ratio of TRE/B may be 2.24 or more and 2.65 or less, 2.31 or more and 2.65 or less, 2.36 or more and 2.61 or less, 2.36 or more and 2.56 or less, and 2.37 or more and 2.56 or less. The residual magnetic flux density and coercive force HcJ tend to increase when TRE/B is within the above range.

In addition, an atomic ratio of 14B/(Fe+Co) may be more than zero to 1.01 or less. Squareness ratio tends to increase when 14B/(Fe+Co) is 1.01 or less. 14B/(Fe+Co) may be 1.00 or less.

An atomic ratio Tb/C, in which Tb content is divided by "C" content, may be 0.10 or more to 0.95 or less. In case when Tb/C is within the above range, temperature coefficient of coercive force HcJ becomes superior and coercive force HcJ at high temperature also improves. In addition, Tb/C may be 0.10 or more and 0.65 or less, 0.15 or more and 0.50 or less or 0.20 or more and 0.45 or less. In addition, Tb/C may be 0.13 or more and 0.63 or less, 0.17 or more and 0.63 or less, 0.21 or more and 0.63 or less, or 0.21 or more and 0.44 or less. In addition, in case when TRL is 29.1 mass % or more and 30.1 mass % or less and Tb/C is within the above range, the temperature coefficient of coercive force HcJ and coercive force HcJ at high temperature further improves.

Carbon, "C", content in the R-T-B based permanent magnet according to the present embodiment relative to a total mass of the R-T-B based permanent magnet may be 1100 ppm or less, 1000 ppm or less, and 900 ppm or less. It may be 600 to 1100 ppm, 600 to 1000 ppm, or 600 to 900 ppm. Coercive force HcJ tends to increase when carbon content is 1100 ppm or less. In particular, considering improving coercive force HcJ, carbon content can be 900 ppm or less. Production of R-T-B based permanent magnet in which carbon content is less than 600 ppm makes process conditions of the R-T-B based permanent magnet severe, which becomes a factor of increasing cost.

Specially, considering improving squareness ratio, carbon content may be 800 to 1100 ppm.

Nitrogen, "N", content in R-T-B based permanent magnet according to the present embodiment relative to a total mass of the R-T-B based permanent magnet may be 1000 ppm or less, 700 ppm or less, or 600 ppm or less. "N" content may be 250 to 1000 ppm, 250 to 700 ppm, or 250 to 600 ppm. Coercive force HcJ becomes easy to increase as nitrogen content is less. Production of R-T-B based permanent magnet in which nitrogen content is less than 250 ppm makes process conditions of the R-T-B based permanent magnet severe, which becomes a factor of increasing cost.

Oxygen, "O", content in R-T-B based permanent magnet according to the present embodiment relative to a total mass of the R-T-B based permanent magnet may be 1000 ppm or less, 800 ppm or less, 700 ppm or less, or 500 ppm or less. It may be 350 to 500 ppm. Although there is no particular lower limit for the oxygen content, production of R-T-B based permanent magnet in which oxygen content is less than 350 ppm makes process conditions of the R-T-B based permanent magnet severe, which becomes a factor of increasing cost.

In addition, by making the "R" content before the latter mentioned grain boundary diffusion 29.1 mass % or more, and the oxygen content 1000 ppm or less, 800 ppm or less, 700 ppm or less or 500 ppm or less, deformation during sintering can be prevented and the production stability can be improved. Note, when the "R" content before the latter mentioned grain boundary diffusion is 29.1 mass % or more, "R" content after the grain boundary diffusion becomes 29.25 mass % or more, for example.

Following reasons can be considered for preventing deformation during sintering by making the total of "R" content within predetermined amount or more and decreasing the oxygen content. The sintering mechanism of an R-T-B based permanent magnet is liquid phase sintering, in which grain boundary phase component called R-rich phase melts to form liquid phase during sintering and promotes densification. On the other hand, "O" is reactive to the R-rich phase, and rare earth oxide phase is formed more when "O" amount increases and the R-rich phase amount decreases. Although in a very small quantity, oxidizing impurity gases generally exist in a sintering furnace. Therefore, during the sintering process, the R-rich phase oxidizes near the surface of a green compact, and the R-rich phase amount may locally decrease. With the composition having a large total "R" content and less "0" amount, the R-rich phase amount is large, and an influence of the oxidation on the shrinking behavior during sintering becomes small. With the composition having less "R" content and/or large "O" amount, the oxidization during sintering affects the shrinking behavior during sintering. As a result, a sintered body is deformed by partial change in shrinkage, namely, partial size change. Thus, deformation during sintering can be prevented by making a total amount of "R" to a prescribed amount or larger and by decreasing "O" content.

A measuring method of components of various kinds included in an R-T-B based permanent magnet according to the present embodiment can be a conventionally and generally known method. Amounts of various kinds of metal elements can be measured by such as X-ray fluorescence analysis, inductively coupled plasma atomic emission spectroscopy (ICP analysis), and etc. Oxygen content is measured by such as inert gas fusion-nondispersive infrared absorption method. Carbon content is measured by such as combustion in oxygen stream-infrared absorption method. Nitrogen content is measured by such an inert gas fusion-thermal conductivity method.

In addition, the R-T-B based permanent magnet according to the present embodiment includes a plurality of main phase grains and grain boundaries. The main phase grain may be a core-shell grain comprising a core and a shell covering the core. And at least in the shell, the heavy rare earth element may be present and Tb may be present.

By making the heavy rare earth element present in the shell part, it is possible to efficiently improve the magnetic properties of the R-T-B based permanent magnet.

In this embodiment, a part where the ratio of the heavy rare earth element to the light rare earth element (molar ratio of heavy rare earth element/light rare earth element) is twice or more of the same ratio in the central part (core) of the main phase grain is defined as the shell.

There is no particular limitation on the thickness of the shell, but it may be 500 nm or less. In addition, diameter of the main phase grain is also not particularly limited, but it may be 3.0 μm or more and 6.5 μm or less.

The method of setting the main phase grain as the above-mentioned core-shell grain is optional. A grain boundary diffusion method described below can be exemplified. The heavy rare earth element diffuses along the grain boundaries and the heavy rare earth element replaces the rare earth element "R" on the surfaces of the main phase grains. Then, shell including high ratio of the heavy rare earth element is formed, and it becomes the core-shell grain.

Hereinafter, a manufacturing method of R-T-B based permanent magnet can be described in detail, however, the method is not limited thereto and the other known methods can be used.

[Preparation Process of Raw Material Powder]

Raw material powder can be prepared by a well-known method. Single alloy method using a single alloy will be described in the present embodiment; however, it can be what is called two alloys method, in which the first and the second alloys mutually having different composition are mixed to prepare a raw material powder.

First, a raw material alloy of R-T-B based permanent magnet is prepared (an alloy preparation process). According to the alloy preparation process, a raw material alloy having desired composition is prepared by melting the raw material metals corresponding to a composition of the R-T-B based permanent magnet of the embodiment by a well-known method, and subsequently casting thereof.

Rare earth metal, rare earth alloy, pure iron, ferroboron, metal such as Co or Cu, alloy thereof, compound thereof, and etc. can be used as the raw material metal. Casting method in which the raw material alloy is casted from the raw material metal can be an optional method. A strip cast method can be used to obtain the R-T-B based permanent magnet having higher magnetic properties. A homogenizing treatment can be performed to the obtained raw material alloy by well-known method when necessary. Also, at this point, the heavy rare earth element added to the raw material metal may be only Dy, and the heavy rare earth element may not be added. In particular, Tb may not be added at this point and Tb may be added only by the grain boundary diffusion described below, and raw material cost can be suppressed.

After preparing the raw material alloy, it is pulverized (pulverization process). Note, an atmosphere of each process, from the pulverization process to the sintering process, can be a low oxygen concentration in the atmosphere in view of obtaining high magnetic properties. For instance, the oxygen concentration in each process can be 200 ppm or less. By controlling the oxygen concentration in each process, oxygen amount included in the R-T-B based permanent magnet can be controlled.

Hereinafter, the pulverization process of a two-step process including a coarse pulverization process, in which the raw material alloy is pulverized till the particle diameter becomes approximately several hundreds μm to several mm, and a fine pulverization process, in which the particle diameter becomes approximately several are described; however, said pulverization process can be one-step process only including the fine pulverization process.

In the coarse pulverization process, the raw material alloy is coarsely pulverized till the particle diameter becomes approximately several hundreds μm to several mm. A coarsely pulverized powder is then obtained. The coarse pulverization method can be an optional method, and it can be a well-known method such as a hydrogen storage pulverization method, a method using a coarse pulverizer, and etc. In case of performing the hydrogen storage pulverization, nitrogen amount included in R-T-B based permanent magnet can be controlled by controlling nitrogen gas concentration in an atmosphere when dehydrogenation treated.

Next, the obtained coarsely pulverized powder is finely pulverized till the average particle diameter becomes approximately several μm (a fine pulverization process). Therefore fine pulverized powder, namely raw material powder, is obtained. Average particle diameter of the fine pulverized powder may be 1 μm or more and 10 μm or less, 2 μm or more and 6 μm or less or 3 μm or more and 5 μm or less. Nitrogen amount included in R-T-B based permanent magnet can be controlled by controlling nitrogen gas concentration in an atmosphere during the fine pulverization process.

The fine pulverization method can be an optional method. For instance, various kinds of the fine pulverizer can be used for the fine pulverization.

In the fine pulverization process of coarsely pulverized powder, fine pulverized powder with high orientation when compacting can be obtained by the addition of various pulverization aids such as lauramide, oleyamide, and etc. In addition, the carbon amount included in R-T-B based permanent magnet can be controlled by varying amount of the pulverization aid added.

[Compacting Process]

In the compacting process, the above-mentioned fine pulverized powder is compacted to a desired shape. Compacting can be performed in an optional method. According to the present embodiment, the fine pulverized powder above is filled in a die and compressed in a magnetic field. According to thus obtained green compact, main phase crystals are oriented in a specific direction. Therefore, the R-T-B based permanent magnet having higher residual magnetic flux density can be obtained.

Compaction pressure may be 20 MPa to 300 MPa. Applied magnetic field may be 950 kA/m or more, or may be 950 kA/m to 1,600 kA/m. The applied magnetic field is not limited to a static magnetic field, and can be a pulse magnetic field. In addition, the static magnetic field and the pulse magnetic field can be combinedly used.

Note, as the compacting process, a wet compacting, which compacts slurry in which fine pulverized powder is dispersed in a solvent such as oil, can be used in addition to a dry compacting mentioned-above, which compacts the fine pulverized powder as it is.

A shape of the green compact obtained by compacting the fine pulverized powder can be an optional shape. In addition, density of the green compact at this point can be 4.0 $Mg/m^3$ to 4.3 $Mg/m^3$.

[Sintering Process]

Sintering process is a process in which the green compact is sintered in a vacuum or in an inert gas atmosphere and a sintered body is obtained. Although sintering temperature is required to be adjusted corresponding to conditions, such as the composition, the pulverization method, the particle size and the particle size distribution, a firing is processed by heating the green compact such as in vacuum or under inert gas, at 1,000° C. or more to 1,200° C. or less and for one hour or more to 20 hours or less. Thus, the sintered body with high density can be obtained. In the present embodiment, the sintered body having the lowest density of 7.45 $Mg/m^3$ is obtained. The density of the sintered body can be 7.50 $Mg/m^3$ or more.

[Aging Treatment Process]

Aging treatment process is a process in which the sintered body is heat treated at lower temperature than the sintering temperature. Whether the aging treatment is performed is not particularly limited and the number of the aging treatment steps is also not particularly limited, and it is suitably performed according to the desired magnetic properties. In addition, when the latter mentioned grain boundary diffusion process is adopted, said process can also be the aging treatment process. The aging treatments of two steps are performed to the R-T-B based permanent magnet of the embodiment. Hereinafter, the embodiment in which aging treatments of two steps are performed is described.

The aging treatment process of the first time is defined "the first aging process" and the aging treatment process of the second time is defined "the second aging process". An aging temperature of the first aging process is defined as T1 and an aging temperature of the second aging process is defined as T2.

Temperature T1 and the aging time during the first aging process are not particularly limited, and may be 700° C. or more and 900° C. or less and one hour to 10 hours.

Temperature T2 and the aging time during the second aging process are not particularly limited, and may be 500° C. or more and 700° C. or less and one hour to 10 hours.

By such aging treatments, the magnetic properties, especially the coercive force HcJ, of the finally obtained R-T-B based permanent magnet can be improved.

Hereinafter, a method in which Tb is diffused along the grain boundaries in the R-T-B based permanent magnet of the present embodiment is described.

[Machining Process (Before the Grain Boundary Diffusion)]

Before the grain boundary diffusion, a process for machining the R-T-B based permanent magnet according to the present embodiment to show a desired shape may be employed when necessary. The machining process exemplifies a shape machining such as cutting and grinding, chamfering such as barrel polishing, and etc.

[Grain Boundary Diffusion Process]

Grain boundary diffusion is performed by heat treating after adhering heavy rare earth metal, compound, alloy, and etc., each including heavy rare earth element on the surface of the R-T-B based permanent magnet by application, coating, deposition, and etc. Coercive force HcJ of the finally obtained R-T-B based permanent magnet can be further enhanced by the grain boundary diffusion of the heavy rare earth element. Tb is preferable as the heavy rare earth element which is diffused along the grain boundaries in the sintered body. It becomes possible to obtain higher coercive force HcJ by using Tb.

In the embodiments hereinafter, an applying material such as slurry, paste, and etc., including Tb is prepared, and the applying material is applied on the surface of the R-T-B based permanent magnet.

State of the applying material is optional, e.g. powdery state, slurry state, etc. What is used as the compound including Tb is optional, and what is used as the solvent or the dispersion medium is also optional. In addition, the concentration of Tb in the applying material is also optional.

A diffusing treatment temperature during the grain boundary diffusion process according to the present embodiment can be 800 to 950° C. The diffusion treatment time can be one hour to 50 hours. Note, the grain boundary diffusion process can also be the above-mentioned aging treatment process.

By setting the diffusion treatment temperature and the diffusion treatment time as described above, the manufacturing cost can be kept low and the concentration distribution of Tb can be easily made suitable.

An additional heat treatment may be performed after the grain boundary diffusion treatment. In this case, the heat treatment temperature may be 450 to 600° C. The heat treatment time may be one hour to 10 hours. The magnetic properties, especially coercive force HcJ, of the finally obtained R-T-B based permanent magnet can be further enhanced by such heat treatment.

The production stability of R-T-B based permanent magnet of the present embodiment can be confirmed by the difference of the magnetic properties due to the change of the aging temperature, the diffusion treatment temperature, the heat treatment temperature after the diffusion. Hereinafter, the diffusion treatment process is described; however, it is the same with the aging temperature and the heat treatment temperature after the diffusion.

For instance, in case when the difference of the magnetic properties due to the change of the diffusion treatment temperature is large, the magnetic properties change by the small change of the diffusion treatment temperature. Therefore, an acceptable range of the diffusion treatment temperature during the grain boundary diffusion process becomes narrow and the production stability becomes low. On the contrary, in case when the difference of the magnetic properties due to the change of the diffusion treatment temperature is small, the magnetic properties become difficult to change even the diffusion treatment temperature changes. Therefore, the acceptable range of the diffusion treatment temperature during the grain boundary diffusion process becomes wide and the production stability becomes high. Furthermore, it becomes possible to process the grain boundary diffusion at high temperature in short time, so that production cost can be reduced.

[Machining Process (after the Grain Boundary Diffusion)]

Various kinds of the machining may be performed on the R-T-B based permanent magnet after the grain boundary diffusion process. A kind of the machining is not particularly limited. For instance, shape machining such as cutting and grinding, surface machining such as chamfering including barrel polishing, and etc. can be performed.

The R-T-B based permanent magnet of the present embodiment obtained by the above method becomes an R-T-B based permanent magnet product by magnetizing.

Thus obtained R-T-B based permanent magnet according to the present embodiment has desired characteristics. Specifically, the residual magnetic flux density Br and the coercive force HcJ are high, and corrosion resistance and production stability are also excellent.

The R-T-B based permanent magnet according to the present embodiment is suitably used for a motor, an electric generator, and etc.

Note, the invention is not limited to the above described embodiment and can be varied within the scope of the invention.

The manufacturing method of said R-T-B based permanent magnet is not limited thereto and may be suitably changed. For instance, although the R-T-B based permanent magnet of the embodiment is manufactured by sintering method, the R-T-B based permanent magnet may be manufactured by hot deformation method. The manufacturing method of the R-T-B based permanent magnet by the hot deformation method includes the following processes.

(a) A rapid quenching process, in which the raw material metal is melted and the obtained molten metal is rapidly cooled to obtain a thin ribbon.

(b) A pulverization process, in which the thin ribbon is pulverized and flake-like raw material powder is obtained.

(c) A cold compacting process, in which the pulverized raw material powder is cold compacted.

(d) A preheating process, in which the cold compacted body is preheated.

(e) A hot compacting process, in which the preheated cold compacted body is hot compacted.

(f) A hot plastic deforming process, in which the hot compacted body is plastically deformed to a predetermined shape.

(g) An aging treatment process, in which the R-T-B based permanent magnet is made aging treatment.

The processes after the aging treatment process are the same as the manufacture by sintering.

EXAMPLE

Hereinafter, the invention will be described in detail referring to examples; however, the invention is not limited thereto.

Example 1

(Manufacturing R-T-B Based Sintered Magnet)

Nd, Pr, electrolytic iron and low carbon ferroboron alloy were prepared as the raw material. Further, Al, Ga, Cu, Co, Mn and Zr were prepared as a pure metal or an alloy with Fe.

The raw material alloy was prepared by strip casting method using the above-mentioned raw materials to make the finally obtained magnet composition after the below mentioned grain boundary diffusion to show the composition of each sample shown in Tables 1 and 2. Content (ppm) of "C", "N" and "O" shown in Tables 1 and 2 each show the content with respect to a total mass of the magnet. Fe is not shown in Table 2, however, content (mass %) of each element other than "C", "N" and "O" shown in Tables 1 and 2 are values when the total content of Nd, Pr, Tb, B, Al, Ga, Cu, Co, Mn, Zr and Fe are 100 mass %. The thickness of said raw material alloy was 0.2 to 0.4 mm.

Subsequently, hydrogen was absorbed by flowing hydrogen gas into said raw material alloy at room temperature for one hour. Then, the atmosphere was changed to Ar gas and a dehydrogenation treatment was performed at 600° C. for one hour, and hydrogen storage pulverization was performed to said raw material alloy. Considering sample numbers 81 to 83, nitrogen gas concentration in the atmosphere during the dehydrogenation treatment was regulated to make nitrogen content to be a predetermined amount. Subsequently, after cooling, said dehydrogenation treated raw material alloy were sieved to be powder having particle diameter of 425 μm or less. Note, from the hydrogen storage pulverization process to the latter mentioned sintering process, the atmosphere was a low oxygen atmosphere in which an oxygen concentration is always less than 200 ppm. Considering sample numbers 74 to 78, the oxygen concentration was regulated making oxygen content to be a predetermined amount.

Subsequently, a mass ratio of 0.1% oleyamide was added as the pulverization aid with respect to the raw material alloy powder after the hydrogen storage pulverization and sieving, and then mixed thereof. Considering sample numbers 63 to 68, amount of the pulverization aid added was regulated in order to make the carbon content to be a predetermined amount.

Subsequently, the obtained powder was finely pulverized in a nitrogen gas stream using an impact plate type jet mill apparatus, and fine powder (raw material powder) having average particle diameter of 3.9 to 4.2 μm was obtained. Considering samples 79 and 80, the obtained powder was finely pulverized in a mixed gas stream of Ar and nitrogen, and the nitrogen gas concentration was adjusted to make the nitrogen content to be a predetermined amount. Note, said average particle diameter is average particle diameter D50 measured by a laser diffraction type particle size analyzer.

The obtained fine powder was compacted in the magnetic field and a green compact was manufactured. The applied magnetic field when compacting was a static magnetic field of 1,200 kA/m. The compaction pressure was 98 MPa. A magnetic field applied direction and a compressing direction were at a right angle. Density of the green compact at this point was measured. Densities of all the compacted bodies were within 4.10 $Mg/m^3$ to 4.25 $Mg/m^3$.

Subsequently, the green compact was sintered and a sintered body was obtained. Optimum conditions of the sintering vary according to such as the composition; however, they were set within 1,040° C. to 1,100° C. and held for four hours. Sintering atmosphere was a vacuum. The sintered density at this point was within 7.45 $Mg/m^3$ to 7.55 $Mg/m^3$. Then, in Ar atmosphere under an atmospheric pressure, the first aging treatment was performed at the first aging temperature T1=850° C. for one hour, and the second aging treatment was further performed at the second aging temperature T2=520° C. for one hour.

Subsequently, the sintered magnet after aging treatment was ground to 14 mm×10 mm×4.2 mm (the thickness in the direction of easy axis of magnetization was 4.2 mm) by a vertical grinding machine, and the sintered body before the grain boundary diffusion of Tb mentioned below was manufactured.

In addition, the sintered body obtained in the above process was etched by carrying out a set of treatments of immersing in a mixed solution of nitric acid and ethanol including 3 mass % of nitric acid with respect to 100 mass % of ethanol for three minutes and then immersing in ethanol for one minute. Said set of treatments was repeated twice. Subsequently, slurry, in which $TbH_2$ particles (average particle diameter D50=10.0 μm) were dispersed in ethanol, was applied on the whole area of the sintered magnet after the etching treatment, making a mass ratio of Tb to a mass of the sintered magnet to be 0.2 to 1.2 mass %. The applied amount was changed to show Tb content described in Table 1 and 2.

After applying and drying the slurry, the diffusion treatment was performed in flowing Ar atmosphere (1 atm) at 930° C. for 18 hours, and then the heat treatment was performed at 520° C. for four hours. Then, the surfaces of the samples of 14×10×4.2 mm were ground by 0.1 mm per each face, and then R-T-B based sintered magnet of each sample shown in Tables 1 and 2 were obtained.

The average composition of each obtained R-T-B based sintered magnet was measured. Each sample was pulverized by a stamp mill and analyzed thereof. The amounts of various elements were measured by the X-ray fluorescence analysis. Boron (B) content was measured by the ICP analysis. Oxygen content was measured by the inert gas fusion-nondispersive infrared absorption method. Carbon content was measured by the combustion in oxygen stream-infrared absorption method. Nitrogen content was measured by the inert gas fusion-thermal conductivity method. Results are shown in Tables 1 and 2. Note, in the present example, TRE, the total of "R" content, was 28.20 mass % or more and 30.50 mass % or less.

The magnetic properties of the each obtained R-T-B based sintered magnet were evaluated by BH tracer. The magnetic properties were evaluated after magnetizing by 4,000 kA/m pulse magnetic field. A thickness of the sintered magnet was thin. Thus, three sintered magnets were layered one on top of the other, and evaluated thereof. Results are shown in Tables 1 and 2.

Generally, the residual magnetic flux density and the coercive force HcJ are in the relationship of a trade-off. Namely, the coercive force HcJ tends to be low as the residual magnetic flux density is high, and the residual magnetic flux density tends to be low as the coercive force HcJ is high. Accordingly, a performance index PI (Potential Index) was set in the present embodiment to comprehensively evaluate the residual magnetic flux density and the coercive force HcJ. The following equation was defined when the magnitude of the residual magnetic flux density measured by mT unit is Br (mT) and the same of coercive force HcJ measured by kA/m unit is HcJ (kA/m).

$$PI = Br + 25 \times HcJ \times 4\pi / 2{,}000$$

According to the present example, in case of PI≥1,745, the residual magnetic flux density and the coercive force HcJ were regarded as good. In case of PI≥1,765, the residual magnetic flux density and the coercive force HcJ were regarded particularly good. The squareness ratio Hk/HcJ of 90% or more was determined to be good. According to Tables 1 and 2, samples showing good PI and squareness ratio were defined "○", while not good were defined "x". Note, the squareness ratio Hk/HcJ in the present invention was calculated by Hk/HcJ×100(%) when Hk (kA/m) is the magnetic field when the magnetization J reaches 90% of Br in the second quadrant (J-H demagnetization curve) of magnetization J-magnetic field H curve.

In addition, corrosion resistance of each R-T-B based sintered magnet was tested. Corrosion resistance was tested by PCT test, Pressure Cooker Test, under a saturated moisture content air. In concrete, mass change of the R-T-B based sintered magnet before and after the test under pressure of 2 atm for 1,000 hours in 100% RH atmosphere was measured. The corrosion resistance was regarded as good in case when the mass decrease per a total surface area of the magnet was 3 mg/cm$^2$ or less. Note, all the samples among the corrosion resistance tested samples in the invention were good.

TABLE 1

| | R-T-B based sintered magnet composition (after Tb diffusion) | | | | | | | | | | | |
|---|---|---|---|---|---|---|---|---|---|---|---|---|
| Sample No. | Nd (mass %) | Pr (mass %) | TRL (mass %) | Tb (mass %) | TRE (mass %) | B (mass %) | TRE/B (atomic ratio) | Al (mass %) | Ga (mass %) | Cu (mass %) | Co (mass %) | Mn (mass %) |
| 1* | 22.9 | 7.6 | 30.5 | 0.35 | 30.85 | 0.96 | 2.42 | 0.20 | 0.20 | 0.20 | 2.0 | 0.03 |
| 2* | 22.9 | 7.6 | 30.5 | 0.35 | 30.85 | 0.95 | 2.45 | 0.20 | 0.20 | 0.20 | 2.0 | 0.03 |
| 3* | 22.9 | 7.6 | 30.5 | 0.35 | 30.85 | 0.94 | 2.47 | 0.20 | 0.20 | 0.20 | 2.0 | 0.03 |
| 4* | 22.9 | 7.6 | 30.5 | 0.35 | 30.85 | 0.93 | 2.50 | 0.20 | 0.20 | 0.20 | 2.0 | 0.03 |
| 5* | 22.9 | 7.6 | 30.5 | 0.35 | 30.85 | 0.90 | 2.58 | 0.20 | 0.20 | 0.20 | 2.0 | 0.03 |
| 6* | 22.9 | 7.6 | 30.5 | 0.35 | 30.85 | 0.88 | 2.64 | 0.20 | 0.20 | 0.20 | 2.0 | 0.03 |
| 7* | 22.9 | 7.6 | 30.5 | 0.35 | 30.85 | 0.85 | 2.73 | 0.20 | 0.20 | 0.20 | 2.0 | 0.03 |
| 8* | 22.6 | 7.5 | 30.1 | 0.35 | 30.45 | 0.96 | 2.39 | 0.20 | 0.20 | 0.20 | 2.0 | 0.03 |
| 9 | 22.6 | 7.5 | 30.1 | 0.35 | 30.45 | 0.95 | 2.41 | 0.20 | 0.20 | 0.20 | 2.0 | 0.03 |
| 10 | 22.6 | 7.5 | 30.1 | 0.35 | 30.45 | 0.94 | 2.44 | 0.20 | 0.20 | 0.20 | 2.0 | 0.03 |
| 11 | 22.6 | 7.5 | 30.1 | 0.35 | 30.45 | 0.93 | 2.47 | 0.20 | 0.20 | 0.20 | 2.0 | 0.03 |
| 12 | 22.6 | 7.5 | 30.1 | 0.35 | 30.45 | 0.90 | 2.55 | 0.20 | 0.20 | 0.20 | 2.0 | 0.03 |
| 13 | 22.6 | 7.5 | 30.1 | 0.35 | 30.45 | 0.88 | 2.61 | 0.20 | 0.20 | 0.20 | 2.0 | 0.03 |
| 14* | 22.2 | 7.4 | 29.6 | 0.35 | 29.95 | 0.96 | 2.35 | 0.20 | 0.20 | 0.20 | 2.0 | 0.03 |
| 15 | 22.2 | 7.4 | 29.6 | 0.35 | 29.95 | 0.95 | 2.37 | 0.20 | 0.20 | 0.20 | 2.0 | 0.03 |
| 16 | 22.2 | 7.4 | 29.6 | 0.35 | 29.95 | 0.94 | 2.40 | 0.20 | 0.20 | 0.20 | 2.0 | 0.03 |
| 17 | 22.2 | 7.4 | 29.6 | 0.35 | 29.95 | 0.93 | 2.43 | 0.20 | 0.20 | 0.20 | 2.0 | 0.03 |
| 18 | 22.2 | 7.4 | 29.6 | 0.35 | 29.95 | 0.90 | 2.51 | 0.20 | 0.20 | 0.20 | 2.0 | 0.03 |
| 19 | 22.2 | 7.4 | 29.6 | 0.35 | 29.95 | 0.88 | 2.56 | 0.20 | 0.20 | 0.20 | 2.0 | 0.03 |
| 20 | 22.2 | 7.4 | 29.6 | 0.35 | 29.95 | 0.85 | 2.65 | 0.20 | 0.20 | 0.20 | 2.0 | 0.03 |
| 21* | 21.8 | 7.3 | 29.1 | 0.35 | 29.45 | 0.96 | 2.31 | 0.20 | 0.20 | 0.20 | 2.0 | 0.03 |
| 22 | 21.8 | 7.3 | 29.1 | 0.35 | 29.45 | 0.95 | 2.33 | 0.20 | 0.20 | 0.20 | 2.0 | 0.03 |
| 23 | 21.8 | 7.3 | 29.1 | 0.35 | 29.45 | 0.94 | 2.36 | 0.20 | 0.20 | 0.20 | 2.0 | 0.03 |
| 24 | 21.8 | 7.3 | 29.1 | 0.35 | 29.45 | 0.93 | 2.39 | 0.20 | 0.20 | 0.20 | 2.0 | 0.03 |
| 25 | 21.8 | 7.3 | 29.1 | 0.35 | 29.45 | 0.90 | 2.46 | 0.20 | 0.20 | 0.20 | 2.0 | 0.03 |
| 26 | 21.8 | 7.3 | 29.1 | 0.35 | 29.45 | 0.88 | 2.52 | 0.20 | 0.20 | 0.20 | 2.0 | 0.03 |
| 27 | 21.8 | 7.3 | 29.1 | 0.35 | 29.45 | 0.85 | 2.61 | 0.20 | 0.20 | 0.20 | 2.0 | 0.03 |
| 28* | 21.6 | 7.2 | 28.8 | 0.35 | 29.15 | 0.96 | 2.29 | 0.20 | 0.20 | 0.20 | 2.0 | 0.03 |
| 29 | 21.6 | 7.2 | 28.8 | 0.35 | 29.15 | 0.95 | 2.31 | 0.20 | 0.20 | 0.20 | 2.0 | 0.03 |
| 30 | 21.6 | 7.2 | 28.8 | 0.35 | 29.15 | 0.94 | 2.34 | 0.20 | 0.20 | 0.20 | 2.0 | 0.03 |
| 31 | 21.6 | 7.2 | 28.8 | 0.35 | 29.15 | 0.93 | 2.36 | 0.20 | 0.20 | 0.20 | 2.0 | 0.03 |
| 32 | 21.6 | 7.2 | 28.8 | 0.35 | 29.15 | 0.90 | 2.44 | 0.20 | 0.20 | 0.20 | 2.0 | 0.03 |
| 33 | 21.6 | 7.2 | 28.8 | 0.35 | 29.15 | 0.88 | 2.49 | 0.20 | 0.20 | 0.20 | 2.0 | 0.03 |
| 34 | 21.6 | 7.2 | 28.8 | 0.35 | 29.15 | 0.85 | 2.58 | 0.20 | 0.20 | 0.20 | 2.0 | 0.03 |
| 35* | 20.9 | 7.0 | 27.9 | 0.35 | 28.25 | 0.96 | 2.22 | 0.20 | 0.20 | 0.20 | 2.0 | 0.03 |
| 36 | 20.9 | 7.0 | 27.9 | 0.35 | 28.25 | 0.95 | 2.24 | 0.20 | 0.20 | 0.20 | 2.0 | 0.03 |
| 37 | 20.9 | 7.0 | 27.9 | 0.35 | 28.25 | 0.94 | 2.26 | 0.20 | 0.20 | 0.20 | 2.0 | 0.03 |
| 38 | 20.9 | 7.0 | 27.9 | 0.35 | 28.25 | 0.93 | 2.29 | 0.20 | 0.20 | 0.20 | 2.0 | 0.03 |
| 39 | 20.9 | 7.0 | 27.9 | 0.35 | 28.25 | 0.90 | 2.36 | 0.20 | 0.20 | 0.20 | 2.0 | 0.03 |
| 40 | 20.9 | 7.0 | 27.9 | 0.35 | 28.25 | 0.88 | 2.42 | 0.20 | 0.20 | 0.20 | 2.0 | 0.03 |

| | R-T-B based sintered magnet composition (after Tb diffusion) | | | | | | | | | | | |
|---|---|---|---|---|---|---|---|---|---|---|---|---|
| Sample No. | Zr (mass %) | Tb/C (atomic ratio) | Fe (mass %) | C (ppm) | N (ppm) | O (ppm) | 14B/(Fe + Co) (atomic ratio) | Br (mT) | HcJ (kA/m) | Hk/HcJ (%) | Potential Index | PI, Hk/HcJ Evaluation |
| 1* | 0.15 | 0.29 | 65.41 | 900 | 500 | 500 | 1.03 | 1432 | 1919 | 92.1 | 1733 | X |
| 2* | 0.15 | 0.29 | 65.42 | 900 | 500 | 500 | 1.02 | 1435 | 1931 | 97.8 | 1738 | X |

TABLE 1-continued

| | | | | | | | | | | | | |
|---|---|---|---|---|---|---|---|---|---|---|---|---|
| 3* | 0.15 | 0.29 | 65.43 | 900 | 500 | 500 | 1.01 | 1434 | 1953 | 97.8 | 1741 | X |
| 4* | 0.15 | 0.29 | 65.44 | 900 | 500 | 500 | 1.00 | 1433 | 1965 | 97.8 | 1742 | X |
| 5* | 0.15 | 0.29 | 65.47 | 900 | 500 | 500 | 0.97 | 1432 | 1973 | 97.3 | 1741 | X |
| 6* | 0.15 | 0.29 | 65.49 | 900 | 500 | 500 | 0.94 | 1429 | 1974 | 97.8 | 1739 | X |
| 7* | 0.15 | 0.29 | 65.52 | 900 | 500 | 500 | 0.91 | 1416 | 1927 | 97.2 | 1719 | X |
| 8* | 0.15 | 0.29 | 65.81 | 900 | 500 | 500 | 1.03 | 1445 | 1917 | 86.5 | 1746 | X |
| 9 | 0.15 | 0.29 | 65.82 | 900 | 500 | 500 | 1.01 | 1448 | 1934 | 98.0 | 1752 | ○ |
| 10 | 0.15 | 0.29 | 65.83 | 900 | 500 | 500 | 1.00 | 1447 | 1952 | 98.5 | 1754 | ○ |
| 11 | 0.15 | 0.29 | 65.84 | 900 | 500 | 500 | 0.99 | 1445 | 1961 | 98.7 | 1753 | ○ |
| 12 | 0.15 | 0.29 | 65.87 | 900 | 500 | 500 | 0.96 | 1440 | 1973 | 98.3 | 1750 | ○ |
| 13 | 0.15 | 0.29 | 65.89 | 900 | 500 | 500 | 0.94 | 1440 | 1970 | 98.3 | 1749 | ○ |
| 14* | 0.15 | 0.29 | 66.31 | 900 | 500 | 500 | 1.02 | 1464 | 1913 | 85.9 | 1764 | X |
| 15 | 0.15 | 0.29 | 66.32 | 900 | 500 | 500 | 1.01 | 1465 | 1928 | 98.1 | 1768 | ○ |
| 16 | 0.15 | 0.29 | 66.33 | 900 | 500 | 500 | 1.00 | 1465 | 1946 | 98.1 | 1771 | ○ |
| 17 | 0.15 | 0.29 | 66.34 | 900 | 500 | 500 | 0.99 | 1464 | 1958 | 98.1 | 1772 | ○ |
| 18 | 0.15 | 0.29 | 66.37 | 900 | 500 | 500 | 0.95 | 1461 | 1970 | 98.0 | 1770 | ○ |
| 19 | 0.15 | 0.29 | 66.39 | 900 | 500 | 500 | 0.93 | 1458 | 1964 | 98.1 | 1767 | ○ |
| 20 | 0.15 | 0.29 | 66.42 | 900 | 500 | 500 | 0.90 | 1445 | 1925 | 98.0 | 1747 | ○ |
| 21* | 0.15 | 0.29 | 66.81 | 900 | 500 | 500 | 1.01 | 1476 | 1871 | 83.2 | 1770 | X |
| 22 | 0.15 | 0.29 | 66.82 | 900 | 500 | 500 | 1.00 | 1474 | 1893 | 97.8 | 1771 | ○ |
| 23 | 0.15 | 0.29 | 66.83 | 900 | 500 | 500 | 0.99 | 1475 | 1917 | 98.8 | 1776 | ○ |
| 24 | 0.15 | 0.29 | 66.84 | 900 | 500 | 500 | 0.98 | 1472 | 1932 | 99.1 | 1775 | ○ |
| 25 | 0.15 | 0.29 | 66.87 | 900 | 500 | 500 | 0.95 | 1469 | 1952 | 99.0 | 1776 | ○ |
| 26 | 0.15 | 0.29 | 66.89 | 900 | 500 | 500 | 0.93 | 1467 | 1953 | 98.9 | 1774 | ○ |
| 27 | 0.15 | 0.29 | 66.92 | 900 | 500 | 500 | 0.89 | 1456 | 1894 | 97.8 | 1754 | ○ |
| 28* | 0.15 | 0.29 | 67.11 | 900 | 500 | 500 | 1.01 | 1476 | 1851 | 89.4 | 1767 | X |
| 29 | 0.15 | 0.29 | 67.12 | 900 | 500 | 500 | 1.00 | 1481 | 1873 | 97.7 | 1775 | ○ |
| 30 | 0.15 | 0.29 | 67.13 | 900 | 500 | 500 | 0.99 | 1479 | 1891 | 97.2 | 1776 | ○ |
| 31 | 0.15 | 0.29 | 67.14 | 900 | 500 | 500 | 0.97 | 1481 | 1913 | 97.3 | 1781 | ○ |
| 32 | 0.15 | 0.29 | 67.17 | 900 | 500 | 500 | 0.94 | 1476 | 1932 | 95.7 | 1779 | ○ |
| 33 | 0.15 | 0.29 | 67.19 | 900 | 500 | 500 | 0.92 | 1474 | 1933 | 96.0 | 1778 | ○ |
| 34 | 0.15 | 0.29 | 67.22 | 900 | 500 | 500 | 0.89 | 1461 | 1872 | 95.5 | 1755 | ○ |
| 35* | 0.15 | 0.29 | 68.01 | 900 | 500 | 500 | 0.99 | 1471 | 1776 | 89.1 | 1750 | X |
| 36 | 0.15 | 0.29 | 68.02 | 900 | 500 | 500 | 0.98 | 1476 | 1802 | 99.0 | 1759 | ○ |
| 37 | 0.15 | 0.29 | 68.03 | 900 | 500 | 500 | 0.97 | 1470 | 1824 | 98.4 | 1757 | ○ |
| 38 | 0.15 | 0.29 | 68.04 | 900 | 500 | 500 | 0.96 | 1468 | 1846 | 98.5 | 1758 | ○ |
| 39 | 0.15 | 0.29 | 68.07 | 900 | 500 | 500 | 0.93 | 1468 | 1851 | 98.2 | 1759 | ○ |
| 40 | 0.15 | 0.29 | 68.09 | 900 | 500 | 500 | 0.91 | 1466 | 1840 | 98.0 | 1755 | ○ |

*is Comp. Ex.

○ is a good characteristic

X is a not good characteristic

TABLE 2

| | R-T-B based sintered magnet composition (after Tb diffusion) | | | | | | | | | |
|---|---|---|---|---|---|---|---|---|---|---|
| Sample No. | Nd (mass %) | Pr (mass %) | TRL (mass %) | Tb (mass %) | TRE (mass %) | B (mass %) | Al (mass %) | Ga (mass %) | Cu (mass %) | Co (mass %) |
| 41 | 22.2 | 7.4 | 29.6 | 0.35 | 29.95 | 0.93 | 0.20 | 0.20 | 0.20 | 0.5 |
| 42 | 22.2 | 7.4 | 29.6 | 0.35 | 29.95 | 0.93 | 0.20 | 0.20 | 0.20 | 1.0 |
| 17 | 22.2 | 7.4 | 29.6 | 0.35 | 29.95 | 0.93 | 0.20 | 0.20 | 0.20 | 2.0 |
| 44 | 22.2 | 7.4 | 29.6 | 0.35 | 29.95 | 0.93 | 0.20 | 0.20 | 0.20 | 3.0 |
| 45 | 22.2 | 7.4 | 29.6 | 0.35 | 29.95 | 0.93 | 0.15 | 0.20 | 0.20 | 2.0 |
| 17 | 22.2 | 7.4 | 29.6 | 0.35 | 29.95 | 0.93 | 0.20 | 0.20 | 0.20 | 2.0 |
| 47 | 22.2 | 7.4 | 29.6 | 0.35 | 29.95 | 0.93 | 0.25 | 0.20 | 0.20 | 2.0 |
| 48 | 22.2 | 7.4 | 29.6 | 0.35 | 29.95 | 0.93 | 0.30 | 0.20 | 0.20 | 2.0 |
| 49 | 22.2 | 7.4 | 29.6 | 0.35 | 29.95 | 0.93 | 0.20 | 0.20 | 0.04 | 2.0 |
| 50 | 22.2 | 7.4 | 29.6 | 0.35 | 29.95 | 0.93 | 0.20 | 0.20 | 0.10 | 2.0 |
| 17 | 22.2 | 7.4 | 29.6 | 0.35 | 29.95 | 0.93 | 0.20 | 0.20 | 0.20 | 2.0 |
| 52 | 22.2 | 7.4 | 29.6 | 0.35 | 29.95 | 0.93 | 0.20 | 0.20 | 0.30 | 2.0 |
| 53 | 22.2 | 7.4 | 29.6 | 0.35 | 29.95 | 0.93 | 0.20 | 0.20 | 0.50 | 2.0 |
| 54 | 22.2 | 7.4 | 29.6 | 0.35 | 29.95 | 0.93 | 0.20 | 0.08 | 0.20 | 2.0 |
| 55 | 22.2 | 7.4 | 29.6 | 0.35 | 29.95 | 0.93 | 0.20 | 0.10 | 0.20 | 2.0 |
| 17 | 22.2 | 7.4 | 29.6 | 0.35 | 29.95 | 0.93 | 0.20 | 0.20 | 0.20 | 2.0 |
| 57 | 22.2 | 7.4 | 29.6 | 0.35 | 29.95 | 0.93 | 0.20 | 0.25 | 0.20 | 2.0 |
| 58 | 22.2 | 7.4 | 29.6 | 0.35 | 29.95 | 0.93 | 0.20 | 0.30 | 0.20 | 2.0 |
| 59 | 22.2 | 7.4 | 29.6 | 0.35 | 29.95 | 0.93 | 0.20 | 0.20 | 0.20 | 2.0 |
| 60 | 22.2 | 7.4 | 29.6 | 0.35 | 29.95 | 0.93 | 0.20 | 0.20 | 0.20 | 2.0 |
| 17 | 22.2 | 7.4 | 29.6 | 0.35 | 29.95 | 0.93 | 0.20 | 0.20 | 0.20 | 2.0 |
| 62 | 22.2 | 7.4 | 29.6 | 0.35 | 29.95 | 0.93 | 0.20 | 0.20 | 0.20 | 2.0 |
| 63 | 22.2 | 7.4 | 29.6 | 0.35 | 29.95 | 0.93 | 0.20 | 0.20 | 0.20 | 2.0 |
| 64 | 22.2 | 7.4 | 29.6 | 0.35 | 29.95 | 0.93 | 0.20 | 0.20 | 0.20 | 2.0 |
| 17 | 22.2 | 7.4 | 29.6 | 0.35 | 29.95 | 0.93 | 0.20 | 0.20 | 0.20 | 2.0 |
| 65 | 22.2 | 7.4 | 29.6 | 0.35 | 29.95 | 0.93 | 0.20 | 0.20 | 0.20 | 2.0 |
| 66 | 22.2 | 7.4 | 29.6 | 0.35 | 29.95 | 0.93 | 0.20 | 0.20 | 0.20 | 2.0 |
| 67 | 22.2 | 7.4 | 29.6 | 0.30 | 29.90 | 0.93 | 0.20 | 0.20 | 0.20 | 2.0 |

TABLE 2-continued

| | | | | | | | | | | |
|---|---|---|---|---|---|---|---|---|---|---|
| 68 | 22.2 | 7.4 | 29.6 | 0.50 | 30.10 | 0.93 | 0.20 | 0.20 | 0.20 | 2.0 |
| 69 | 22.2 | 7.4 | 29.6 | 0.15 | 29.75 | 0.93 | 0.20 | 0.20 | 0.20 | 2.0 |
| 70 | 22.2 | 7.4 | 29.6 | 0.20 | 29.80 | 0.93 | 0.20 | 0.20 | 0.20 | 2.0 |
| 71 | 22.2 | 7.4 | 29.6 | 0.50 | 30.10 | 0.93 | 0.20 | 0.20 | 0.20 | 2.0 |
| 71a | 22.2 | 7.4 | 29.6 | 0.75 | 30.35 | 0.93 | 0.20 | 0.20 | 0.20 | 2.0 |
| 72 | 22.5 | 7.5 | 30.0 | 0.50 | 30.50 | 0.93 | 0.20 | 0.20 | 0.20 | 2.0 |
| 73 | 20.9 | 7.0 | 27.9 | 0.30 | 28.20 | 0.93 | 0.20 | 0.20 | 0.20 | 2.0 |
| 74 | 22.2 | 7.4 | 29.6 | 0.35 | 29.95 | 0.93 | 0.20 | 0.20 | 0.20 | 2.0 |
| 75 | 22.2 | 7.4 | 29.6 | 0.35 | 29.95 | 0.93 | 0.20 | 0.20 | 0.20 | 2.0 |
| 17 | 22.2 | 7.4 | 29.6 | 0.35 | 29.95 | 0.93 | 0.20 | 0.20 | 0.20 | 2.0 |
| 77 | 22.2 | 7.4 | 29.6 | 0.35 | 29.95 | 0.93 | 0.20 | 0.20 | 0.20 | 2.0 |
| 78 | 22.2 | 7.4 | 29.6 | 0.35 | 29.95 | 0.93 | 0.20 | 0.20 | 0.20 | 2.0 |
| 79 | 22.2 | 7.4 | 29.6 | 0.35 | 29.95 | 0.93 | 0.20 | 0.20 | 0.20 | 2.0 |
| 80 | 22.2 | 7.4 | 29.6 | 0.35 | 29.95 | 0.93 | 0.20 | 0.20 | 0.20 | 2.0 |
| 17 | 22.2 | 7.4 | 29.6 | 0.35 | 29.95 | 0.93 | 0.20 | 0.20 | 0.20 | 2.0 |
| 81 | 22.2 | 7.4 | 29.6 | 0.35 | 29.95 | 0.93 | 0.20 | 0.20 | 0.20 | 2.0 |
| 82 | 22.2 | 7.4 | 29.6 | 0.35 | 29.95 | 0.93 | 0.20 | 0.20 | 0.20 | 2.0 |
| 83 | 22.2 | 7.4 | 29.6 | 0.35 | 29.95 | 0.93 | 0.20 | 0.20 | 0.20 | 2.0 |
| 84 | 29.6 | 0.0 | 29.6 | 0.35 | 29.95 | 0.93 | 0.20 | 0.20 | 0.20 | 2.0 |
| 85 | 24.6 | 5.0 | 29.6 | 0.35 | 29.95 | 0.93 | 0.20 | 0.20 | 0.20 | 2.0 |
| 17 | 22.2 | 7.4 | 29.6 | 0.35 | 29.95 | 0.93 | 0.20 | 0.20 | 0.20 | 2.0 |
| 87 | 19.6 | 10.0 | 29.6 | 0.35 | 29.95 | 0.93 | 0.20 | 0.20 | 0.20 | 2.0 |

| Sample No. | Mn (mass %) | Zr (mass %) | Tb/C (atomic ratio) | C (ppm) | N (ppm) | O (ppm) | Br (mT) | HcJ (kA/m) | Hk/HcJ (%) | Potential Index | Pl, Hk/HcJ Evaluation |
|---|---|---|---|---|---|---|---|---|---|---|---|
| 41 | 0.03 | 0.15 | 0.29 | 900 | 500 | 500 | 1463 | 1928 | 98.1 | 1766 | ○ |
| 42 | 0.03 | 0.15 | 0.29 | 900 | 500 | 500 | 1465 | 1937 | 98.1 | 1769 | ○ |
| 17 | 0.03 | 0.15 | 0.29 | 900 | 500 | 500 | 1464 | 1958 | 98.1 | 1772 | ○ |
| 44 | 0.03 | 0.15 | 0.29 | 900 | 500 | 500 | 1464 | 1917 | 98.0 | 1765 | ○ |
| 45 | 0.03 | 0.15 | 0.29 | 900 | 500 | 500 | 1471 | 1911 | 97.9 | 1771 | ○ |
| 17 | 0.03 | 0.15 | 0.29 | 900 | 500 | 500 | 1464 | 1958 | 98.1 | 1772 | ○ |
| 47 | 0.03 | 0.15 | 0.29 | 900 | 500 | 500 | 1456 | 1995 | 98.1 | 1769 | ○ |
| 48 | 0.03 | 0.15 | 0.29 | 900 | 500 | 500 | 1445 | 2029 | 97.8 | 1764 | ○ |
| 49 | 0.03 | 0.15 | 0.29 | 900 | 500 | 500 | 1466 | 1931 | 98.0 | 1769 | ○ |
| 50 | 0.03 | 0.15 | 0.29 | 900 | 500 | 500 | 1468 | 1944 | 97.7 | 1773 | ○ |
| 17 | 0.03 | 0.15 | 0.29 | 900 | 500 | 500 | 1464 | 1958 | 98.1 | 1772 | ○ |
| 52 | 0.03 | 0.15 | 0.29 | 900 | 500 | 500 | 1461 | 1958 | 98.2 | 1769 | ○ |
| 53 | 0.03 | 0.15 | 0.29 | 900 | 500 | 500 | 1456 | 1923 | 97.6 | 1758 | ○ |
| 54 | 0.03 | 0.15 | 0.29 | 900 | 500 | 500 | 1467 | 1931 | 98.3 | 1770 | ○ |
| 55 | 0.03 | 0.15 | 0.29 | 900 | 500 | 500 | 1466 | 1936 | 98.5 | 1770 | ○ |
| 17 | 0.03 | 0.15 | 0.29 | 900 | 500 | 500 | 1464 | 1958 | 98.1 | 1772 | ○ |
| 57 | 0.03 | 0.15 | 0.29 | 900 | 500 | 500 | 1462 | 1964 | 98.3 | 1771 | ○ |
| 58 | 0.03 | 0.15 | 0.29 | 900 | 500 | 500 | 1461 | 1973 | 98.1 | 1771 | ○ |
| 59 | 0.03 | 0.10 | 0.29 | 900 | 500 | 500 | 1465 | 1951 | 98.0 | 1771 | ○ |
| 60 | 0.03 | 0.15 | 0.29 | 900 | 500 | 500 | 1464 | 1958 | 98.1 | 1772 | ○ |
| 17 | 0.03 | 0.25 | 0.29 | 900 | 500 | 500 | 1459 | 1967 | 97.2 | 1768 | ○ |
| 62 | 0.03 | 0.30 | 0.29 | 900 | 500 | 500 | 1452 | 1958 | 97.2 | 1760 | ○ |
| 63 | 0.03 | 0.15 | 0.44 | 600 | 500 | 500 | 1462 | 2004 | 95.8 | 1777 | ○ |
| 64 | 0.03 | 0.15 | 0.35 | 750 | 500 | 500 | 1460 | 2006 | 95.4 | 1775 | ○ |
| 17 | 0.03 | 0.15 | 0.29 | 900 | 500 | 500 | 1464 | 1958 | 98.1 | 1772 | ○ |
| 65 | 0.03 | 0.15 | 0.26 | 1000 | 500 | 500 | 1464 | 1929 | 98.0 | 1767 | ○ |
| 66 | 0.03 | 0.15 | 0.24 | 1100 | 500 | 500 | 1465 | 1899 | 98.0 | 1763 | ○ |
| 67 | 0.03 | 0.15 | 0.21 | 1100 | 500 | 500 | 1466 | 1859 | 98.2 | 1758 | ○ |
| 68 | 0.03 | 0.15 | 0.63 | 600 | 500 | 500 | 1458 | 2052 | 95.5 | 1780 | ○ |
| 69 | 0.03 | 0.15 | 0.13 | 900 | 500 | 500 | 1466 | 1802 | 98.2 | 1749 | ○ |
| 70 | 0.03 | 0.15 | 0.17 | 900 | 500 | 500 | 1465 | 1890 | 98.0 | 1762 | ○ |
| 71 | 0.03 | 0.15 | 0.42 | 900 | 500 | 500 | 1462 | 2010 | 98.0 | 1778 | ○ |
| 71a | 0.03 | 0.15 | 0.63 | 900 | 500 | 500 | 1456 | 2033 | 97.9 | 1775 | ○ |
| 72 | 0.03 | 0.15 | 0.42 | 900 | 500 | 500 | 1444 | 2019 | 97.2 | 1761 | ○ |
| 73 | 0.03 | 0.15 | 0.25 | 900 | 500 | 500 | 1470 | 1814 | 98.6 | 1755 | ○ |
| 74 | 0.03 | 0.15 | 0.29 | 900 | 500 | 350 | 1464 | 1958 | 98.2 | 1772 | ○ |
| 75 | 0.03 | 0.15 | 0.29 | 900 | 500 | 400 | 1464 | 1959 | 97.9 | 1772 | ○ |
| 17 | 0.03 | 0.15 | 0.29 | 900 | 500 | 500 | 1464 | 1958 | 98.1 | 1772 | ○ |
| 77 | 0.03 | 0.15 | 0.29 | 900 | 500 | 800 | 1465 | 1963 | 98.0 | 1773 | ○ |
| 78 | 0.03 | 0.15 | 0.29 | 900 | 500 | 1000 | 1463 | 1957 | 98.0 | 1770 | ○ |
| 79 | 0.03 | 0.15 | 0.29 | 900 | 250 | 500 | 1465 | 1988 | 98.1 | 1777 | ○ |
| 80 | 0.03 | 0.15 | 0.29 | 900 | 300 | 500 | 1465 | 1987 | 98.2 | 1777 | ○ |
| 17 | 0.03 | 0.15 | 0.29 | 900 | 500 | 500 | 1464 | 1958 | 98.1 | 1772 | ○ |
| 81 | 0.03 | 0.15 | 0.29 | 900 | 600 | 500 | 1463 | 1938 | 98.0 | 1767 | ○ |
| 82 | 0.03 | 0.15 | 0.29 | 900 | 700 | 500 | 1463 | 1918 | 98.0 | 1764 | ○ |
| 83 | 0.03 | 0.15 | 0.29 | 900 | 1000 | 500 | 1464 | 1897 | 98.0 | 1762 | ○ |
| 84 | 0.03 | 0.15 | 0.29 | 900 | 500 | 500 | 1468 | 1934 | 98.2 | 1772 | ○ |
| 85 | 0.03 | 0.15 | 0.29 | 900 | 500 | 500 | 1466 | 1948 | 98.1 | 1772 | ○ |
| 17 | 0.03 | 0.15 | 0.29 | 900 | 500 | 500 | 1464 | 1958 | 98.1 | 1772 | ○ |
| 87 | 0.03 | 0.15 | 0.29 | 900 | 500 | 500 | 1463 | 1969 | 98.1 | 1772 | ○ |

○ is a good characteristic

TRE and "B" were varied in Table 1. Nd and Pr were included making a mass ratio of Nd to Pr to be approximately 3:1. Content of each component other than "B" were varied in Table 2. In samples 84 to 87, TRE was fixed and content of Nd and Pr were varied.

According to Tables 1 and 2, PI and squareness ratio of all the examples were good. In contrast, in all the comparative examples, one or more of PI and squareness ratio was not good. For the R-T-B based sintered magnets of all the examples and comparative examples, the Tb concentration distribution was analyzed using an electron probe micro analyzer (EPMA), and it was confirmed that the Tb concentration decreased from the outer side to the inner side.

NUMERICAL REFERENCES

1 . . . R-T-B based permanent magnets

The invention claimed is:

1. An R-T-B based permanent magnet wherein,

R is a rare earth element and includes at least a light rare earth element and a heavy rare earth element Tb, T is an element other than the rare earth element, B, C, O or N, and B is boron, T at least includes Fe, Cu, Co and Ga, a total of R content is 29.25 to 30.60 mass %, a total of the light rare element content is 29.1 to 30.1 mass %, Cu content is 0.04 to 0.50 mass %, Co content is 1.0 to 3.0 mass %, Ga content is 0.08 to 0.30 mass %, and B content is 0.85 to 0.95 mass %, relative to 100 mass % of a total mass of R, T and B, the R-T-B based permanent magnet further includes O, O content is 350 ppm or more and 800 ppm or less, relative to a total mass of the R-T-B based permanent magnet, an atomic ratio of 14B/(Fe+Co) is more than zero and 1.01 or less, Tb diffuses such that its concentration reduces from outside to inside of the R-T-B based permanent magnet, and the magnet has a potential index of 1,745 or more and 1,781 or less, and a squareness ratio of 90% or more and 99.1% or less after diffusion, and when a magnitude of a residual magnetic flux density measured by mT unit is Br(mT) and a magnitude of coercive force HcJ measured by kA/m unit is HcJ (kA/m), the potential index=Br (mT)+25×HcJ (kA/m)×4π/2,000.

2. The R-T-B based permanent magnet according to claim 1, wherein

R at least includes Nd.

3. The R-T-B based permanent magnet according to claim 1, wherein

R at least includes Pr and

Pr content is more than zero to 10.0 mass % or less.

4. The R-T-B based permanent magnet according to claim 1, wherein R at least includes Nd and Pr.

5. The R-T-B based permanent magnet according to claim 1, wherein

T further includes Al and

Al content is 0.15 to 0.30 mass %.

6. The R-T-B based permanent magnet according to claim 1, wherein

T further includes Zr and

Zr content is 0.10 to 0.30 mass %.

7. The R-T-B based permanent magnet according to claim 1, further including C and C content is 1100 ppm or less relative to a total mass of the R-T-B based permanent magnet.

8. The R-T-B based permanent magnet according to claim 1, further including N and N content is 1000 ppm or less relative to a total mass of the R-T-B based permanent magnet.

9. The R-T-B based permanent magnet according to claim 1, wherein an atomic ratio of Tb/C is 0.10 to 0.95.

10. The R-T-B based permanent magnet according to claim 1, wherein an atomic ratio of TRE/B is 2.2 to 2.7, where TRE is the total of R content.

11. The R-T-B based permanent magnet according to claim 1, wherein the Ga content is 0.10 mass % or more and 0.30 mass % or less.

* * * * *